US008981636B2

(12) United States Patent
Matsuda et al.

(10) Patent No.: US 8,981,636 B2
(45) Date of Patent: Mar. 17, 2015

(54) LAMP HAVING IMPROVED INSULATION OF THE CIRCUIT UNIT

(75) Inventors: Tsugihiro Matsuda, Kyoto (JP); Nobuyoshi Takeuchi, Osaka (JP); Yoshinori Kakuno, Osaka (JP); Masahiro Miki, Osaka (JP); Hideo Nagai, Osaka (JP); Takaari Uemoto, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/234,187

(22) PCT Filed: Feb. 3, 2012

(86) PCT No.: PCT/JP2012/000741

§ 371 (c)(1),
(2), (4) Date: Jan. 22, 2014

(87) PCT Pub. No.: WO2013/014819

PCT Pub. Date: Jan. 31, 2013

(65) Prior Publication Data

US 2014/0152177 A1 Jun. 5, 2014

(30) Foreign Application Priority Data

Jul. 22, 2011 (JP) ..... 2011-160469

(51) Int. Cl.
*F21K 99/00* (2010.01)
*F21V 23/00* (2006.01)

(52) U.S. Cl.
CPC ..... *F21K 9/1355* (2013.01); *F21K 9/135* (2013.01); *F21K 9/90* (2013.01)
USPC ..... 313/318.02

(58) Field of Classification Search
USPC ..... 313/318.01, 318.02; 362/373, 249, 345
See application file for complete search history.

(56) References Cited

U.S. PATENT DOCUMENTS

2010/0327746 A1 12/2010 Hisayasu
2011/0068687 A1 3/2011 Takahasi et al.

(Continued)

FOREIGN PATENT DOCUMENTS

JP 2007-188832 7/2007
JP 2010-86973 4/2010
JP 2010-153101 7/2010

(Continued)

OTHER PUBLICATIONS

International Search Report for PCT/JP2012/000741 dated May 1, 2012.

*Primary Examiner* — Tracie Y Green
(74) *Attorney, Agent, or Firm* — Greenblum & Bernstein, P.L.C.

(57) ABSTRACT

In a lamp: an LED module and a circuit unit for lighting are housed within an envelope composed of a globe and a case; the LED module is attached to an end of an extension member that extends from a mount, which closes an opening at one end of the case, into the globe; the circuit unit is mounted inside the case; an insulation member disposed inside the case ensures insulation between the mount, which is made of metal, and the circuit unit; the insulation member has a bottomed cylinder portion inserted into the mount, and a protrusion portion formed on an outer circumference of the based cylinder portion that protrudes toward an inner surface of the mount; and the insulation member is attached to the mount by the protrusion portion pressing against the inner surface of the mount.

9 Claims, 11 Drawing Sheets

(56) References Cited

U.S. PATENT DOCUMENTS

| | | | | |
|---|---|---|---|---|
| 2011/0089831 | A1 | 4/2011 | Takahasi et al. | |
| 2012/0002421 | A1 | 1/2012 | Takahasi et al. | |
| 2012/0044684 | A1 | 2/2012 | Takahasi et al. | |
| 2012/0300448 | A1 | 11/2012 | Takahasi et al. | |
| 2013/0249381 | A1* | 9/2013 | Takeuchi et al. | 313/292 |
| 2014/0103794 | A1* | 4/2014 | Ueda et al. | 313/318.01 |

FOREIGN PATENT DOCUMENTS

| | | |
|---|---|---|
| JP | 2011-14305 | 1/2011 |
| JP | 4612120 B2 | 1/2011 |
| WO | 2011/087023 | 7/2011 |

* cited by examiner

LAMP HAVING IMPROVED INSULATION OF THE CIRCUIT UNIT

TECHNICAL FIELD

The present invention is related to lamps using light-emitting elements such as LEDs as a light source.

BACKGROUND ART

LEDs are a type of semiconductor light-emitting element. With a view to energy conservation, in recent years a lamp (hereafter, "LED lamp") using LEDs as a light source has been proposed as a bulb-type lamp that is an alternative to an incandescent light bulb.

The LED lamp includes a plurality of LEDs, a mounting board, a case that is cylindrically shaped, a cover member that closes one end of the case, and a circuit unit that enables the LEDs to emit light. The LEDs are mounted on the mounting board, the mounting board is installed on a surface of the cover member, and the circuit unit is fitted inside the case (Patent Literature 1).

In the LED lamp disclosed in Patent Literature 1, the cover member has a function of conducting heat generated when the LEDs emit light to the case, and the case has a heat dissipation function of dissipating heat that is conducted from the cover member. Thus, the cover member and the case are formed from metal material having a high thermal conductivity, and the cover member and the case are joined in contact with each other.

In order to ensure that the circuit unit is in an insulated state inside the case, a resin housing that houses the circuit unit is provided inside the case. Thus, the circuit unit is isolated from the case. The resin housing consists primarily of a main part that is cylindrical and houses the circuit unit, and a cover part that closes an opening at one end of the main part. The cover part is attached to the cover member by using a screw.

CITATION LIST

Patent Literature

[Patent Literature 1]

Japanese Patent Publication No. 4612120

SUMMARY OF INVENTION

Technical Problem

In recent years, consideration is being given to resinification of the case in an LED lamp to achieve weight reduction. In such a case, the main part mentioned above, for ensuring insulation, is unnecessary. However, insulation is still necessary between the cover member, which is made of metal, and the circuit unit.

When using the cover part of the housing in the LED lamp mentioned above as insulation between the cover member and the circuit unit, the cover part and the cover member need to be fixed by a screw, and assembly is awkward.

The present invention aims to provide a lamp having a simple configuration that easily ensures insulation of the circuit unit.

Solution to Problem

The lamp pertaining to the present invention includes: an envelope formed by a globe and a case, a light emitting element disposed inside the envelope, and a circuit unit disposed inside the envelope and configured to light the light-emitting element, wherein the light-emitting element is attached to an extension member that extends from a mount into the globe, the mount closing an opening at one end of the case, the circuit unit being disposed inside the case, which is closed by the mount, the mount is made of an electrically conductive material, and an insulation member is disposed inside the case to insulate the circuit unit from the mount, the mount has a cylinder portion and a cover portion that closes one end of the cylinder portion, and the extension member is mounted on the cover portion of the mount, and the insulation member has a cylindrical portion that is inserted into the cylinder portion of the mount and has a protrusion portion that is formed on an outer circumference of the cylindrical portion and that protrudes toward the mount, the insulation member being attached to the mount by the protrusion portion pressing on an inner surface of the cylinder portion of the mount.

Advantageous Effects of Invention

According to the above configuration, by inserting the cylindrical portion of the insulation member, which ensures insulation of the circuit unit, into the cylinder portion of the mount, the protrusion portion of the insulation member presses the inner surface of the cylinder portion of the mount. Thus, assembly is easy since the insulation member is attached to the mount, as described above, and a simple configuration using the protrusion portion is implemented.

Further, the protrusion portion is a plurality of protrusion portions disposed in a circumferential direction of the cylindrical portion, each protrusion portion being elongated in a direction parallel to the central axis of the cylindrical portion. Alternatively, the protrusion portion is a plurality of protrusion portions disposed in a circumferential direction of the cylindrical portion, each protrusion portion having a bump shape.

Further, the insulation member has an end wall disposed at one of two ends of the cylindrical portion, and the protrusion portion is disposed closer to the other one of the two ends of the cylindrical portion than the one end at which the end wall is disposed. Furthermore, the cover portion of the mount and the end wall of the insulation member are in contact with each other, a through hole passes through the cover portion of the mount and the end wall of the insulation member, and the extension member is fixed by a screw member, which has a head portion disposed inside the cylindrical portion of the insulation member and a screw portion that passes through the through hole.

DESCRIPTION OF EMBODIMENT

The materials and values used in the embodiment only indicate preferable examples, and the present invention is not limited in this way. Also, appropriate changes and modifications may be made without departing from the spirit and scope of the present invention. Further, a combination of the present embodiment and modifications, or a combination of modifications, may be made as long as such combination does not cause contradiction. Furthermore, the scale of the components in each drawing differs from their actual scale.

Embodiment

1. Overall Configuration

Figure 1:
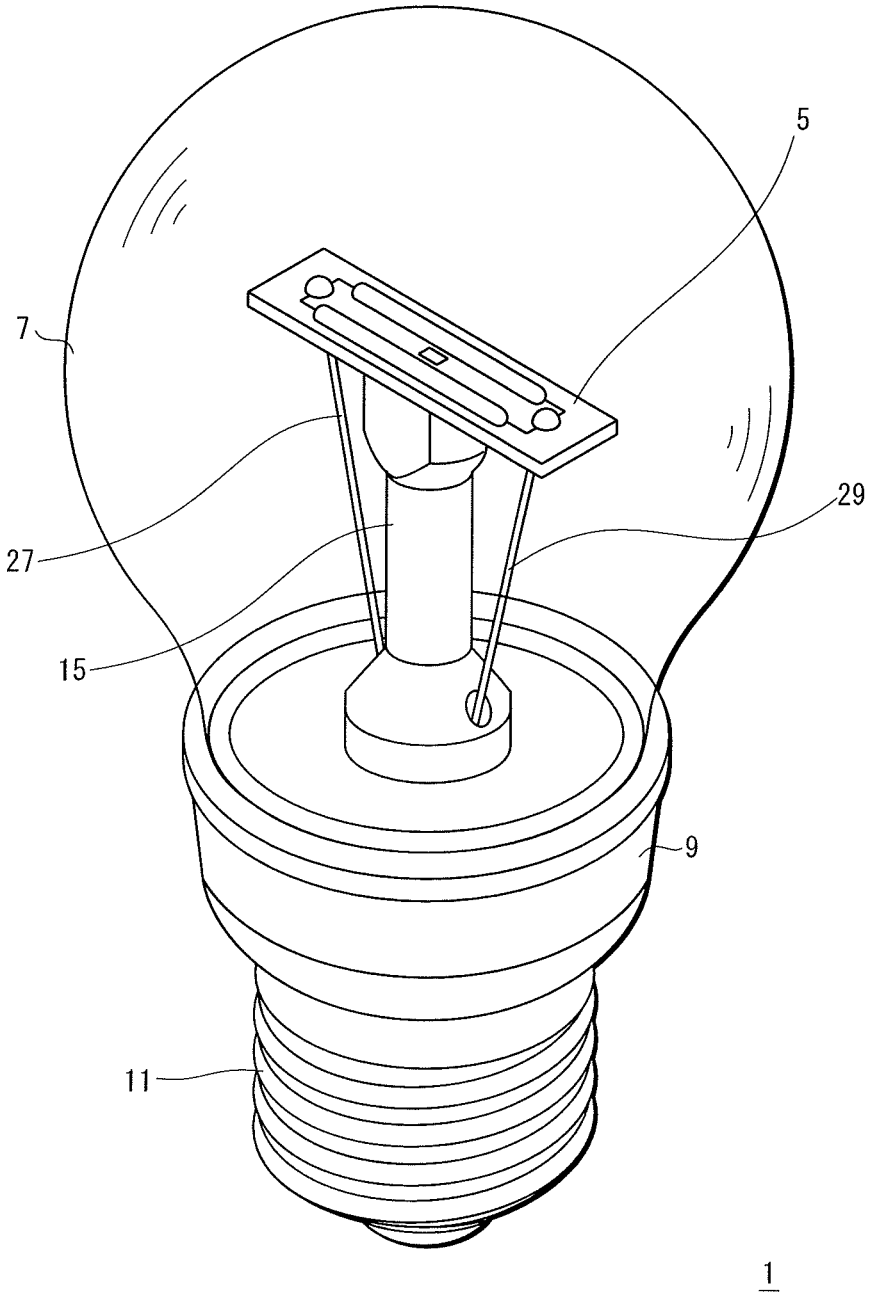
FIG. 1 is a perspective view of an LED lamp pertaining to an embodiment.
Figure 2:
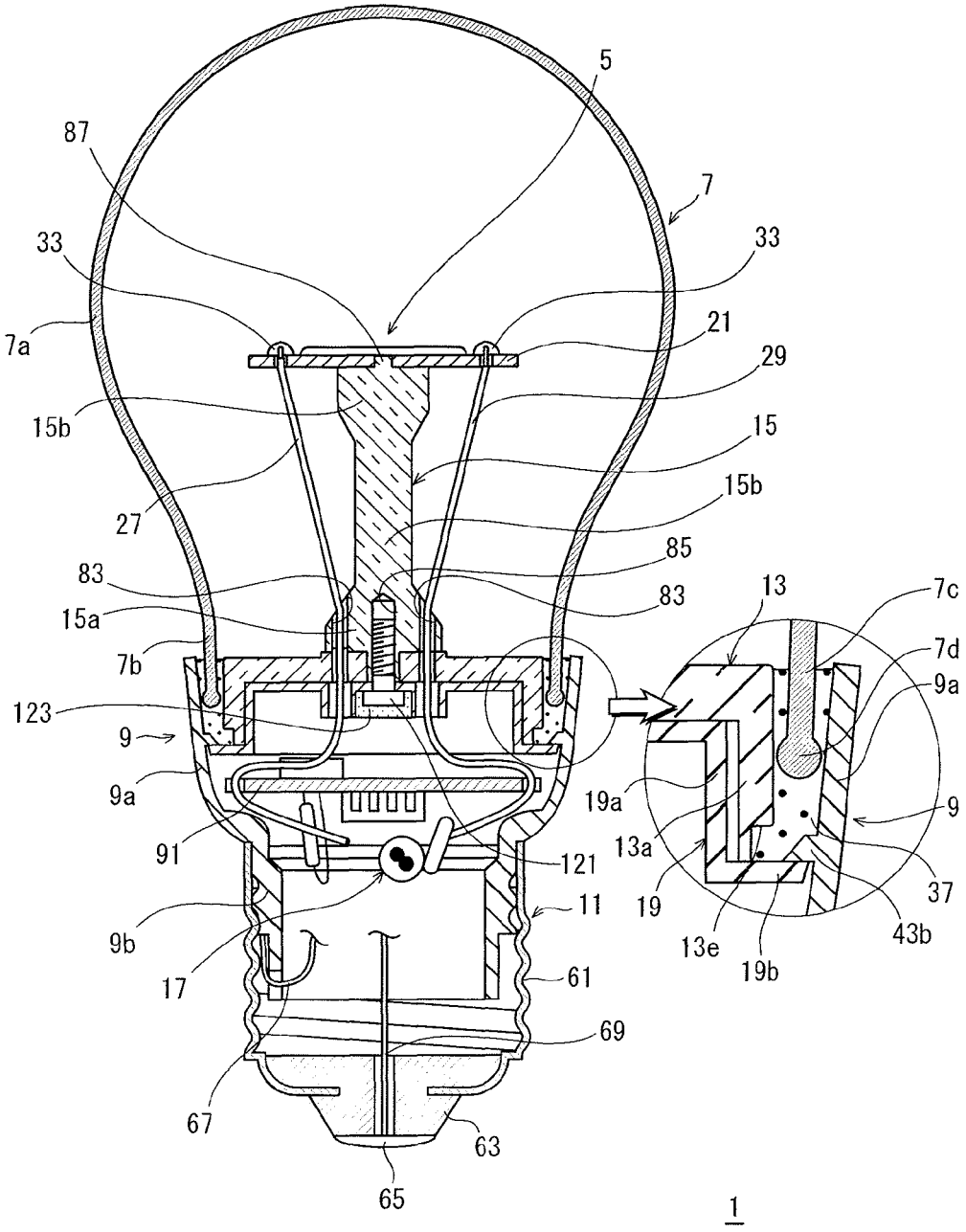
FIG. 2 is a front elevation cross-sectional view of the LED lamp.
Figure 3:
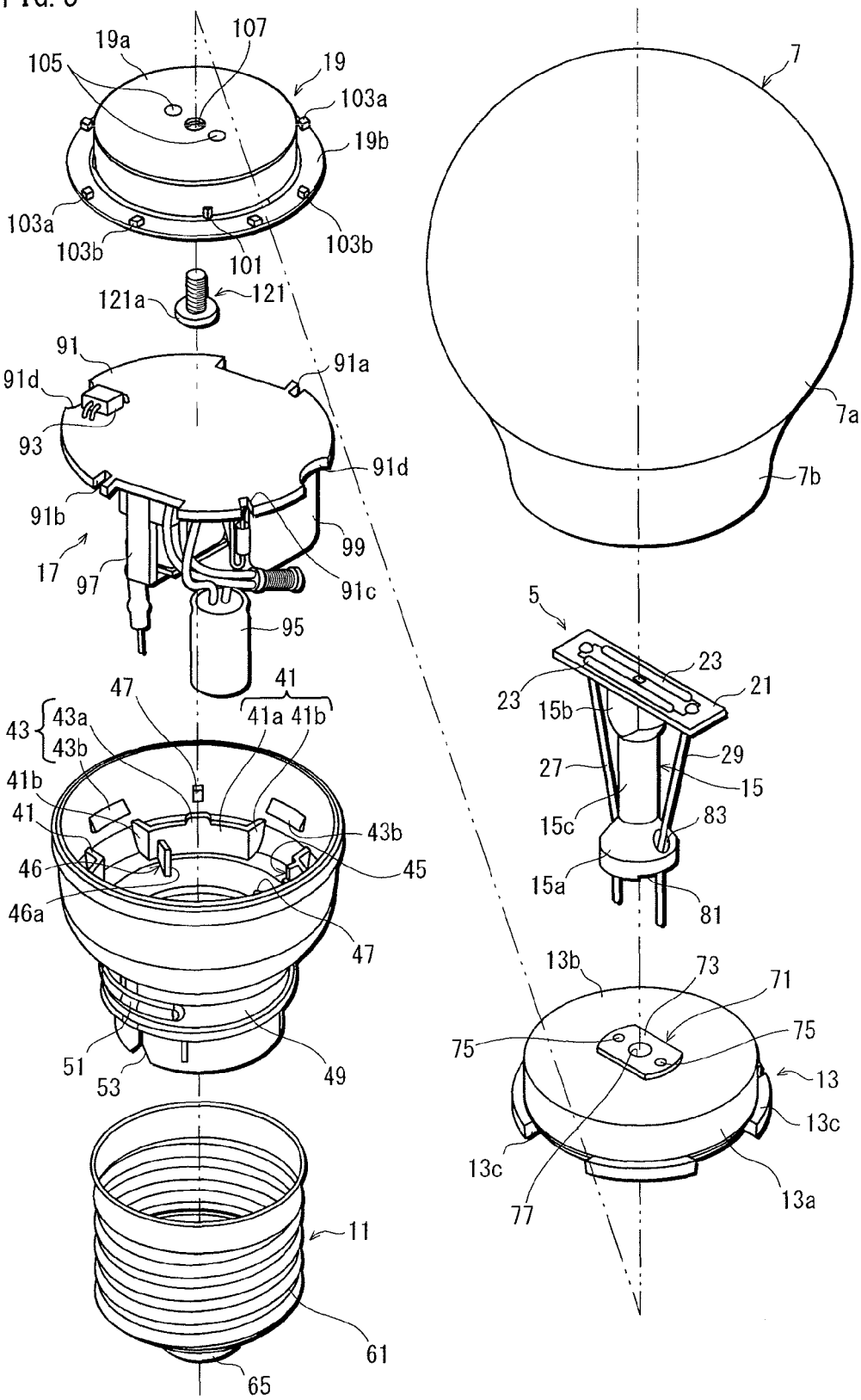
FIG. 3 is an exploded perspective view of the LED lamp.

FIG. 1 is a perspective view of an LED lamp 1 pertaining to the present embodiment. FIG. 2 is a front elevation cross-sectional view of the LED lamp 1. FIG. 3 is an exploded perspective view of the LED lamp 1.

The LED lamp 1 (corresponding to the lamp pertaining to the present invention) includes an LED module 5, a globe 7, a case 9, a base 11, a mount 13, an extension member 15, a circuit unit 17, and an insulation member 19. The LED module 5 includes LEDs 3 that are a light source (refer to FIG. 4B). The globe 7 has the LED module 5 disposed therein. The case 9 is attached to an end portion of the globe 7 at an open side thereof. The base 11 is attached to an end of the case 9 (the lower end in FIG. 1). The mount 13 closes another end of the case 9 and is made of metal. The extension member 15 is attached to the mount 13, extends into the globe 7, and, at the end of the extension, the LED module 5 is mounted thereon. The circuit unit 17 is housed in the case 9, which is closed by the mount 13. The insulation member 19 is disposed in the case 9 and ensures insulation between the mount 13 and the circuit unit 17.

Note that in the present specification, a base direction is a direction along a central axis of the LED lamp downwards toward the base 11 and a globe direction is the opposite direction along the central axis of the LED lamp upwards toward the globe 7. Also, an envelope housing the LED module 5 and the circuit unit 17 includes the globe 7 and the case 9.

2. Configuration of Parts (1) LED Module

Figure 4A:
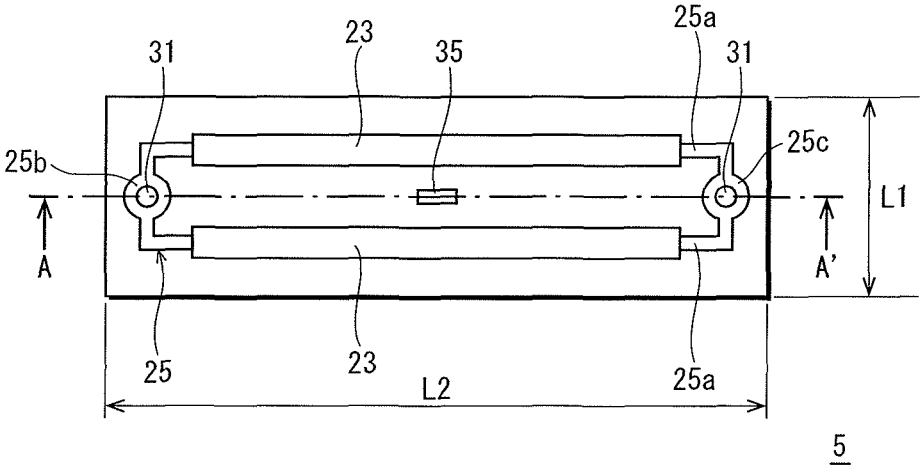
FIGS. 4A and 4B illustrate the structure of an LED module, FIG. 4A being a plan view of the LED module, and FIG. 4B being a cross-sectional view of the LED module taken along the line A-A' in FIG. 4A.
Figure 4B:
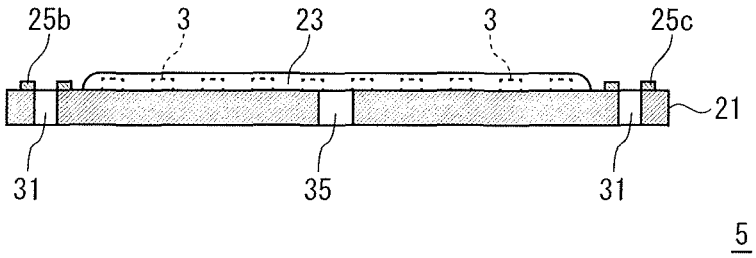

FIGS. 4A and 4B illustrate the structure of the LED module 5. FIG. 4A is a plan view of the LED module 5, and FIG. 4B is a cross-sectional view of the LED module 5 taken along the line A-A' in FIG. 4A.

As shown in FIG. 1, FIG. 2, FIG. 3, and particularly in FIG. 4A and FIG. 4B, the LED module 5 includes a mounting board 21, the LEDs 3, and a sealant 23. The LEDs 3 are mounted on a surface of the mounting board 21 (an upper surface, which is a side facing away from the base 11). The sealant 23 covers the LEDs 3.

The mounting board 21 has a rectangle shape in plan view, and is formed, for example, from a light-transmissive material such as glass or alumina, in order to avoid obstructing light that is emitted backwards, in the base direction, from the LEDs 3.

As shown in FIG. 4A, the mounting board 21 has a conduction path 25, which is composed of a connection pattern 25*a*, a terminal pattern 25*b*, and a terminal pattern 25*c*. The connection pattern 25*a* is for connecting the LEDs 3 (in serial connection and/or parallel connection). The terminal pattern 25*b* and the terminal pattern 25*c* are for connecting a corresponding one of a lead wire 27 and a lead wire 29, which are connected to the circuit unit 17. Note that the conduction path 25 is also made of light-transmissive material, such as ITO, to allow transmission of light from the LEDs 3.

As shown in FIG. 3 and FIG. 4B, the mounting board 21 has two through-holes 31 passing therethrough, formed such that one through-hole 31 passes through the terminal pattern 25*b* and the other through-hole 31 passes through the terminal pattern 25*c*. The lead wire 27 passes through the one through-hole 31 and the lead wire 29 passes through the other through-hole 31. A tip portion of the lead wire 27 and a tip portion of the lead wire 29 are adhered (connected) to the terminal pattern 25*b* and the terminal pattern 25*c*, respectively, by soldering 33.

The mounting board 21 has, in a center thereof in plan view, a fitting hole 35. The fitting hole 35 fits to a fitting protrusion portion 87 of the extension member 15. The fitting hole 35 has a polygonal shape in plan view, and specifically a rectangular shape. Note that the fitting protrusion portion 87 of the extension member 15 also has a rectangular shape, to prevent attachment of the mounting board 21 to the extension member 15 in an incorrect orientation.

The LEDs 3 are mounted on the mounting board 21 in the form of chips. As shown in FIG. 4A and FIG. 4B, the LEDs 3 are disposed at intervals (for example, regular intervals) in two parallel rows in a longitudinal direction of the mounting board 21.

The sealant 23 is primarily composed of a light-transmissive material such as silicone resin, for example. The sealant 23 has a sealant function of preventing air and water penetrating to the LEDs 3, and a wavelength conversion function of converting the wavelength of light from the LEDs 3. The sealant function is implemented by coating each of the rows in which the LEDs 3 are arranged. The wavelength conversion function is implemented by, for example, mixing a conversion material into the light-transmissive material that converts a certain wavelength of light, such as fluorescent particles.

(2) Globe

As shown in FIG. 1, FIG. 2 and FIG. 3, the globe 7 has a similar shape to a bulb of an incandescent light bulb (also called a glass bulb), and is a so-called A-type bulb. The globe 7 is made from light-transmissive material, such as glass.

The globe 7 includes a spherical portion 7*a* that has a hollow spherical shape and a cylindrical portion 7*b* that has a cylindrical shape. The cylindrical portion 7*b* decreases in diameter as distance from the spherical portion 7*a* increases.

As shown in FIG. 2, an opening end portion 7*c* exists at an end portion of the cylindrical portion 7*b*, opposite the spherical portion 7*a*. The opening end portion 7*c* is fixed to the case 9 by adhesive 37. As shown in the enlargement in FIG. 2, an end edge 7*d* of the opening end portion 7*c* has a bulging spherical shape (a sphere having a diameter greater than the thickness of the remainder of the opening end portion 7*c*). The bulging spherical shape prevents the globe 7 from separating from the case 9 (separating from the adhesive 37), because even if adhesion is lost between the globe 7 and the adhesive 37, the end edge 7*d* of the globe 7 is engaged with the adhesive 37.

(3) Case

The case 9 is composed of resin material such as polybutylene terephthalate (PBT) and has a shape similar to the portion of a bulb of an incandescent light bulb that is near a base. In the present embodiment, along a central axis of the case 9, the case 9 has a large diameter portion 9*a* in the globe direction and a small diameter portion 9*b* in the base direction. The large diameter portion 9*a* has a trumpet shape that gradually increases in diameter with distance from the small diameter portion 9*b*.

The case 9 has a function of dissipating heat generated by the circuit unit 17, which generates heat when the LED lamp 1 is lit, to the outside of the case 9. As described above, the circuit unit 17 is housed inside the case 9. Heat dissipation is performed by heat conduction and radiation from the case 9 to the outside air, and by convection of the outside air.

As shown in the enlargement in FIG. 2, an opening at one end of the case 9 is closed by the insertion of the mount 13 into an end portion of the large diameter portion 9*a*. Also, the opening end portion 7*c* of the globe 7 is inserted into a gap between an outer circumferential surface of the mount 13 and an inner circumferential surface of the large diameter portion 9*a* of the case 9. In such a state, the case 9, the globe 7, and the mount 13 are fixed by the adhesive 37.

Figure 5A:
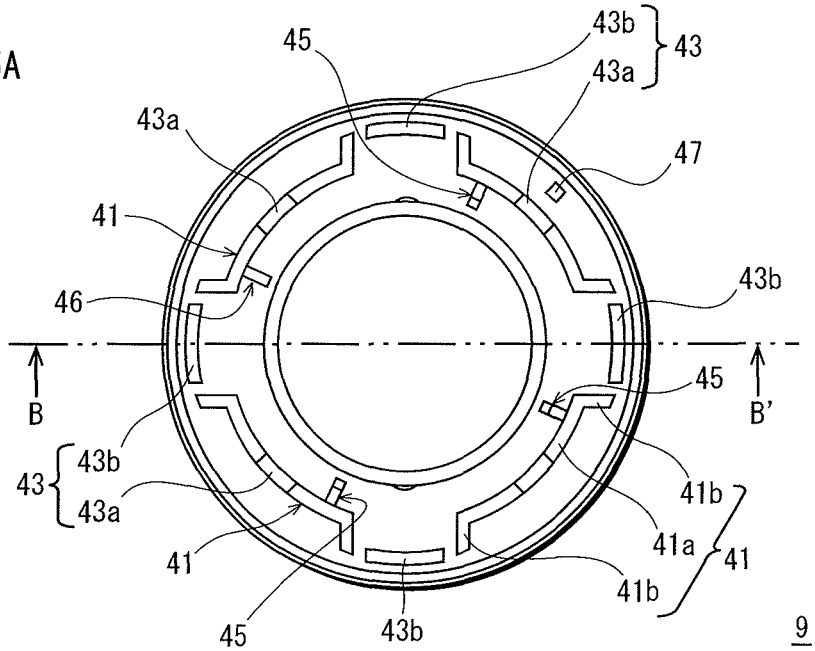
FIGS. 5A and 5B illustrate the structure of a case, FIG. 5A being a plan view of the case, and FIG. 5B being a cross-sectional view of the case taken along the line B-B' in FIG. 5A.
Figure 5B:
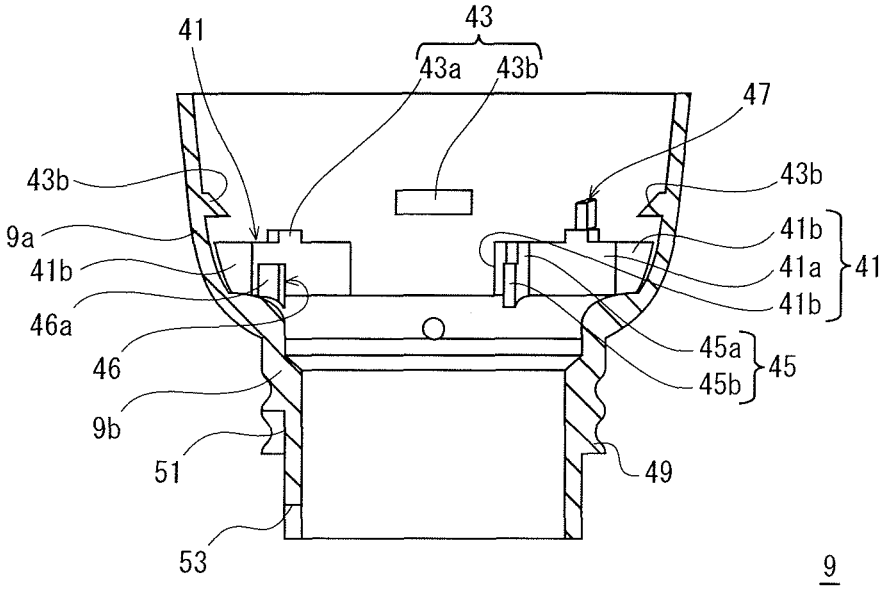

FIGS. 5A and 5B illustrate the structure of the case 9. FIG. 5A is a plan view of the case 9, and FIG. 5B is a cross-sectional view of the case 9 taken along the line B-B' in FIG. 5A.

As shown in FIG. 3 and FIGS. 5A and 5B, disposed inside the large diameter portion 9*a* is a reinforcement unit 41, a fixing unit 43, a support unit 45, a support unit 46, and a rotation restriction unit 47. The reinforcement unit 41 reinforces the large diameter portion 9*a*. The fixing unit 43 fixes the insulation member 19 that is attached to the mount 13. The support unit 45 and the support unit 46 support the circuit unit 17. The rotation restriction unit 47 restricts rotation of the mount 13.

As shown in FIG. 3, the reinforcement unit 41 has an arc portion 41*a*, and a connection portion 41*b*. The arc portion 41*a* has an arc shape that follows a circumferential wall of the large diameter portion 9*a* (which has a cylindrical shape). The arc portion 41*a* is elongated in a direction that is parallel to the central axis of the large diameter portion 9*a*. The connection portion 41*b* connects each end of the arc portion 41*a* in a circumferential direction thereof to the large diameter portion 9*a*. Due to the reinforcement by the reinforcement unit 41, the thickness of the circumferential wall of the large diameter portion 9*a* is reduced and the weight of the case 9 is reduced. Note that the arc portion 41*a*, in plan view (FIG. 5A), has a shape of an interrupted circle centered on a central axis of the large diameter portion 9*a*.

As shown in FIG. 5A, the reinforcement unit 41 is provided in a plurality, in the present embodiment four reinforcement units 41, at regular intervals in a circumferential direction of case 9. Four intervals exist between the four reinforcements units 41 in the circumferential direction of the case 9, and by passing through two of the four intervals, the lead wires 27 and 29 connect to the circuit unit 17 and the LED module 5.

The fixing unit 43 has a support portion 43*a* and a locking portion 43*b*. The support portion 43*a* supports the insulation member 19 from the base direction. The locking portion 43*b* locks the insulation member 19 into position from the globe direction (refer to FIG. 10B).

The support portion 43*a* protrudes in the globe direction (upwards) from a substantially central position of an upper surface of the arc portion 41*a* in the circumferential direction of the case 9. Note that it suffices that the support portion 43*a* supports the insulation member 19 from the base direction, and therefore the support portion 43*a* need not be a protrusion.

The fixing unit 43 is provided in a plurality, in the present embodiment four fixing units 43, at regular intervals in a circumferential direction of the case 9. In plan view, each of the locking portions 43*b* is positioned between two of the reinforcement units 41 that are adjacent in the circumferential direction of the case 9. Note that the present invention is not limited to four of the locking portions 43*b* being provided, and two or more of the locking portions 43*b* are sufficient to fix the insulation member 19 into position.

As shown in FIG. 5B, each of the support unit 45 and the support unit 46 is a ridge portion protruding from an inner surface of a different one of the arc portions 41*a* toward the central axis of the large diameter portion 9*a*, and is elongated toward the small diameter portion 9*b*. In the present embodiment three support units 45 and one support unit 46 are provided, for a total of four ridge portions being provided.

Each of the support unit 45 is composed of a fitting portion 45*a* and a support portion 45*b*. An upper end of the fitting portion 45*a* extends to an upper end of the reinforcement unit 41 (the arc portion 41*a*) and fits into a corresponding one of a cutaway portion 91*a*, a cutaway portion 91*b*, and a cutaway portion 91*c* that are formed on a circuit substrate 91 of the circuit unit 17. The support portion 45*b* is positioned closer to the central axis of the case 9 than the fitting portion 45*a* and supports the circuit substrate 91 from the base direction. Thus, the support units 45 support the circuit substrate 91 and restrict rotation of the circuit substrate 91 inside the case 9.

The upper end of the support portion 45*b* is positioned closer to the base 11 than the upper end of the fitting portion 45*a*, such that a portion of the upper end of each of the support units 45 that is closer to the center of the case 9 is lower than the other portion of the upper end of each of the support units 45, which is farther from the center of the case 9. Thus the supports units 45 each have a stepped shape.

The support unit 46 is composed of a support portion 46*a* that supports the circuit substrate 91 from the base direction. An upper end position of the support portion 46*a* is the same as the upper end position of the support portion 45*b* of the support unit 45. Thus, the circuit substrate 91 is supported orthogonally to the central axis of the case 9, by the support portions 45*b* of the support unit 45 and the support portion 46*a* of the support unit 46.

The rotation restriction unit 47 is formed as a ridge protruding from an area of the inner surface of the large diameter portion 9*a* where the mount 13 is to be attached, toward the central axis of the large diameter portion 9*a*. Further, the rotation restriction unit 47 is elongated along the central axis of the case 9, in the base direction. Furthermore, the rotation restriction unit 47 fits into a restriction groove 13*f* of a flange portion 13*c* of the mount 13. Thus, the rotation restriction unit 47 restricts the mount 13 from rotating inside the case 9.

The small diameter portion 9*b* has a joining unit that joins to the base 11. Specifically, an outer circumferential surface of the small diameter portion 9*b* has a male thread 49 that mates with a thread of the base 11, which is an Edison-type base.

As shown in FIG. 3 and FIG. 5B, part of the outer circumferential surface of the small diameter portion 9*b* has a fixing groove 51 and a cutaway portion 53. The fixing groove 51 is for fixing a lead wire 67 that connects the base 11 and the circuit unit 17. The cutaway portion 53 is at a lower end of the small diameter portion 9*b*, is connected to the fixing groove 51, determines the position of the lead wire 67, and fixes the lead wire 67 into position. The fixing groove 51 is elongated in a direction parallel to the central axis of the case 9.

(4) Base

The base 11 is for receiving power from a socket of a lighting apparatus when the LED lamp 1 is attached to the lighting apparatus and lit.

The base 11 is not specifically limited to any type of base, but an Edison-type base is used in the present embodiment, as shown in FIGS. 1-3. As shown in FIG. 2, the base 11 is composed of a shell portion 61 and an eyelet portion 65. The shell portion 61 has a cylindrical shape and a circumferential wall that is threaded. The eyelet portion 65 is attached to the shell portion 61, and insulation material 63 is between the eyelet portion 65 and the shell portion 61.

The lead wire 67 is connected to the shell portion 61 by being bent back toward the outer circumferential surface of the case 9 at the cutaway portion 53 at the lower end of the small diameter portion 9*b*, by being covered by the shell portion 61 while being inserted into the fixing groove 51 of the case 9. Further, a lead wire 69 is connected to the eyelet portion 65 by soldering. Thus, the base 11 is connected to the circuit unit 17.

(5) Mount

The mount 13 closes an opening at an upper end of the case 9 and has the extension member 15 attached thereto. The mount 13 is formed from metal material (for example, aluminium material) for easy conduction of heat generated by the LED module 5 upon light emission, to the globe 7, the case 9, etc.

Figure 6A:
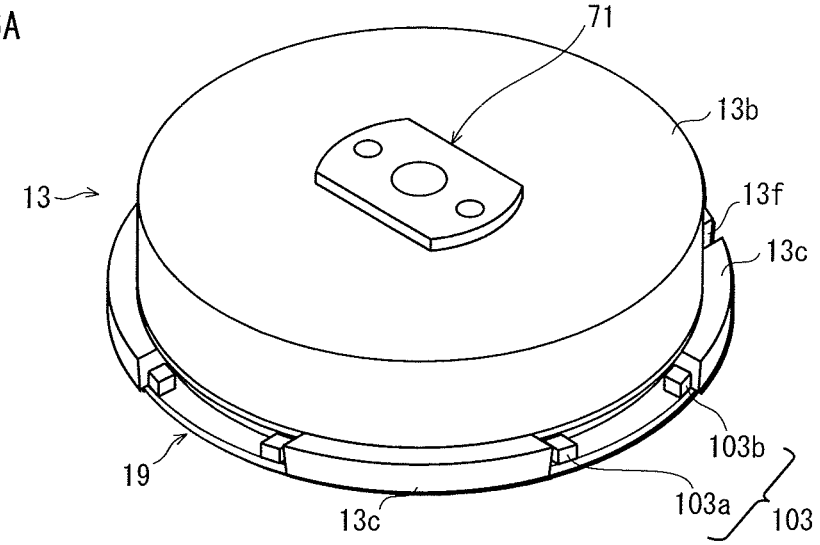
FIG. 6A is a perspective view of a state in which an insulation member is attached to a mount.
Figure 6B:
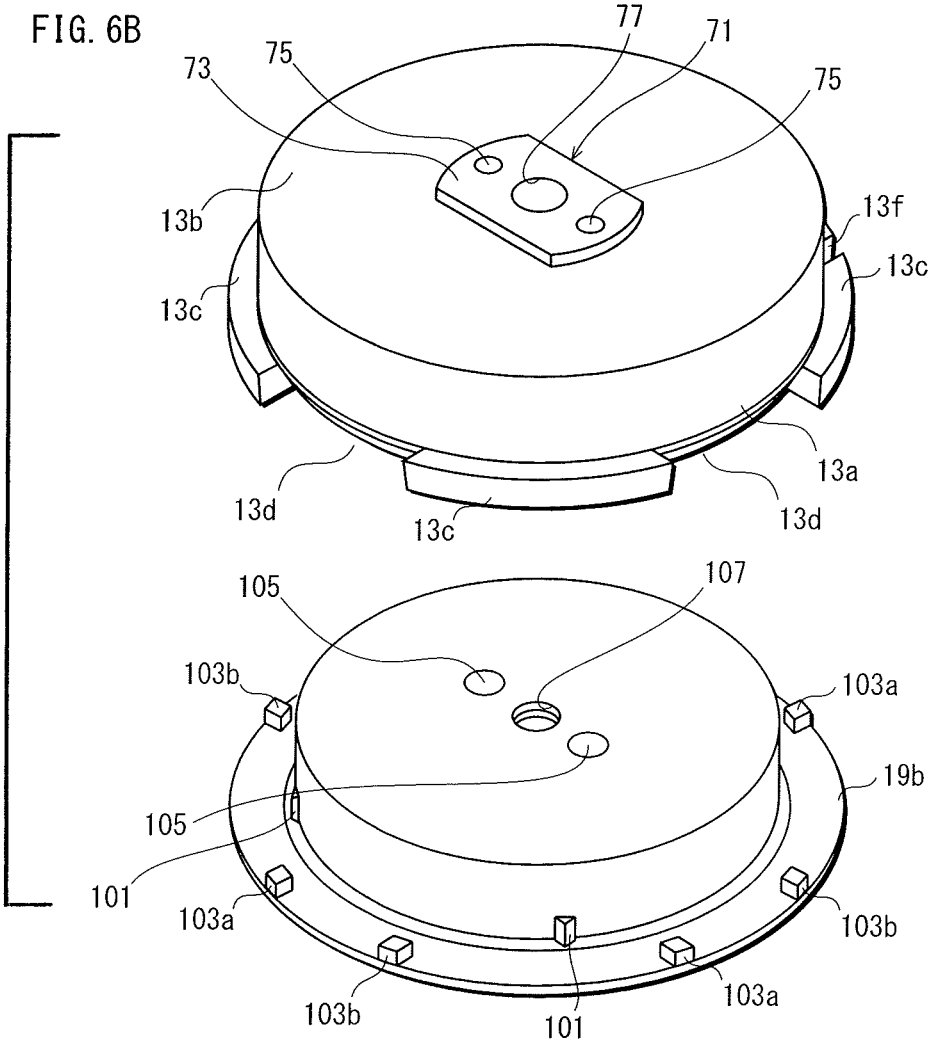
FIG. 6B is a perspective view of the insulation member and the mount in a separated state.
Figure 7A:
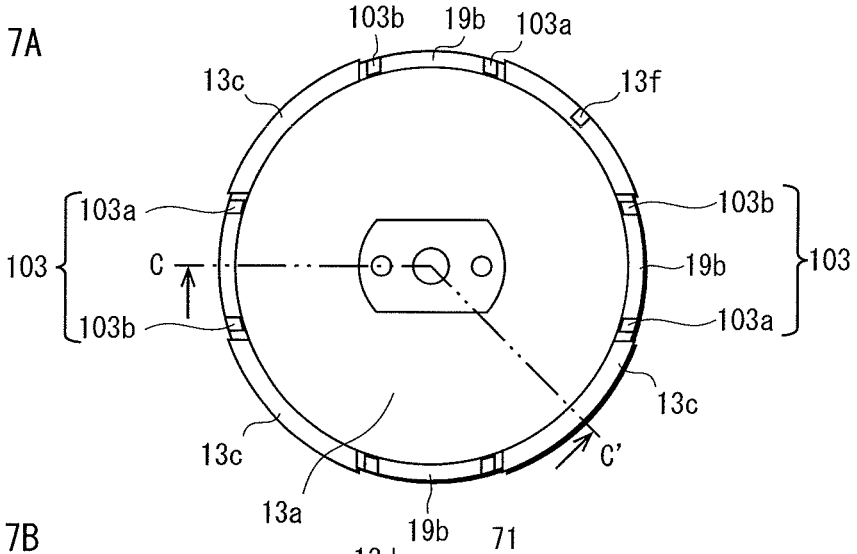
FIG. 7A is a plan view of a state in which the insulation member is attached to the mount.
Figure 7B:
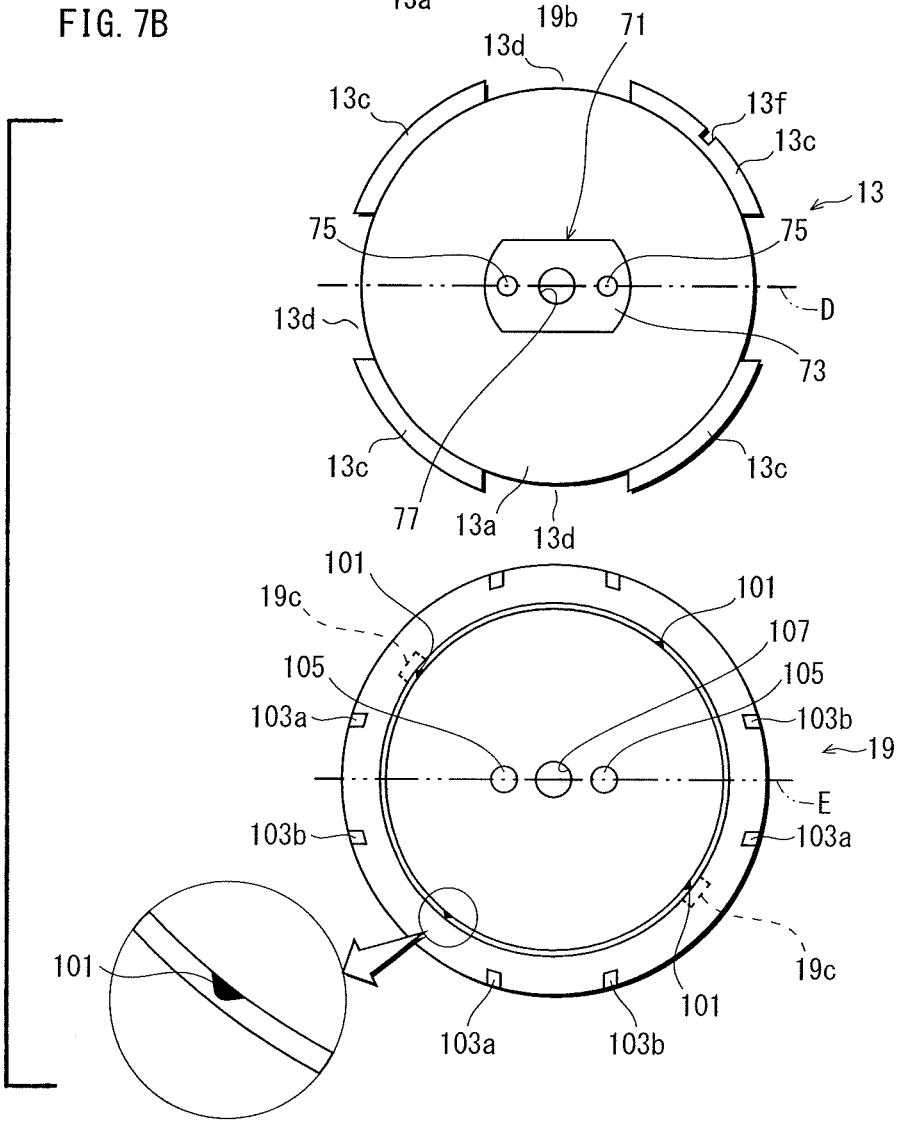
FIG. 7B is a plan view of the insulation member and the mount in a separated state.
Figure 8:
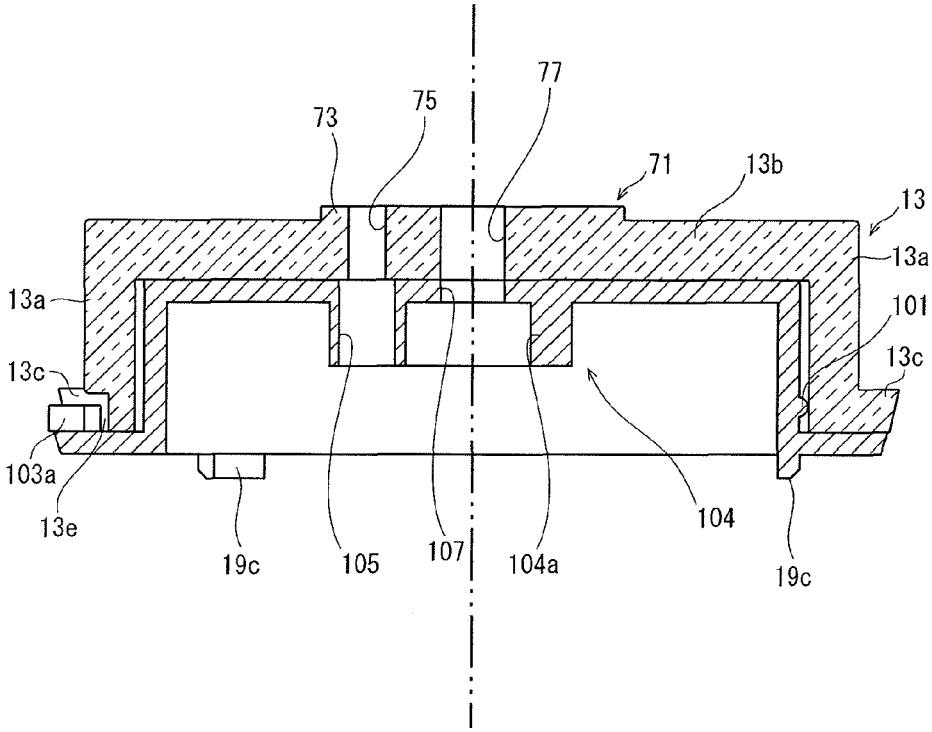
FIG. 8 is a cross-sectional view taken along the line C-C' in FIG. 7A.

FIG. 6A is a perspective view of a state in which the insulation member 19 is attached to the mount 13, and FIG. 6B is a perspective view of the insulation member 19 and the mount 13 in a separated state. FIG. 7A is a plan view of the state in which the insulation member 19 is attached to the mount 13, and FIG. 7B is a plan view of the insulation member 19 and the mount 13 in the separated state. FIG. 8 is a cross-sectional view taken along the line C-C' in FIG. 7A.

As shown in the upper portion of FIG. 6B, the mount 13 has a cylinder portion 13*a*, a cover portion 13*b*, and the flange portion 13*c*. The cover portion 13*b* closes an opening at an upper end of the cylinder portion 13*a* in a central axis direction of the cylinder portion 13*a*. The flange portion 13*c* protrudes from a lower end of the cylinder portion 13*a* in a central axis direction, outward in a radial direction from the central axis of the cylinder portion 13*a*. A central area of an upper surface of the cover portion 13*b* is an attachment area 71 for attaching the extension member 15.

As shown in FIG. 3 and the upper portion of FIG. 6B, the flange portion 13*c* is provided in a plurality (for example, four flange portions 13*c*) at regular intervals in a circumferential direction of the cylinder portion 13*a*. Further, as shown in FIG. 8, at portions of the lower end of the cylinder portion 13*a* without the flange portion 13*c* (indicated as 13*d* in FIG. 6B), step portions 13*e* that are indented toward the central axis of the mount 13 are formed.

As shown in the enlargement in FIG. 2, the adhesive 37 wraps around the step portion 13*e* of the mount 13. Thus, the provision of the step portions 13*e* prevents the adhesive 37 from separating from the case 9 and the mount 13 even if the adhesive 37 between the case 9 and the mount 13 loses adhesion thereto, since the portion of the adhesive 37 around the step portions 13*e* is engaged with the step portions 13*e*. Note that step portions may instead be formed on the case 9 for the adhesive 37 to wrap around.

One of the four flange portions 13*c* has formed therein the restriction groove 13*f*, which is elongated parallel to the central axis of the mount 13. When the mount 13 is attached to the case 9, the restriction groove 13*f* fits onto the rotation restriction unit 47.

The attachment area 71 has a fitting unit that fits with the extension member 15 (refer to FIG. 3). As shown in the upper portion of FIG. 6B, the fitting unit is formed by a fitting protrusion portion 73 that protrudes upwards, for fitting to a fitting groove 81 at a lower end portion of the extension member 15. Two through-holes 75 and a through-hole 77 are formed in the fitting protrusion portion 73, penetrating the fitting protrusion portion 73 in the direction of thickness of the cover portion 13*b*. The two through-holes 75 are for the lead wires 27 and 29, which connect the circuit unit 17 and the LED module 5. The through-hole 77 is for a screw 121 that is for fixing the extension member 15.

The through-hole 77 is positioned along the central axis of the mount 13 (in plan view, the center of the cover portion 13*b*). As shown in the upper portion of FIG. 7B, the through-holes 75 are positioned on an imaginary straight line D that passes through the through-hole 77. In plan view, the imaginary straight line D passes through a substantially central point between opposing pairs of the flange portion 13*c* in the circumferential direction of the mount 13.

(6) Extension Member

As shown in FIG. 3, the extension member 15 has an overall shape of a rod and is formed from metal material, which has high thermal conductivity. The extension member 15 is composed of a base attachment portion 15*a* that is attached to the mount 13, a module attachment portion 15*b* to which the LED module 5 is attached, and a connection portion 15*c* that connects the base attachment portion 15*a* and the module attachment portion 15*b*.

The base attachment portion 15*a* has a circular truncated cone shape that tapers off toward the connection portion 15*c*. The base attachment portion 15*a* has a fitting groove 81 that is rectangular in plan view and is for fitting to the fitting protrusion portion 73 of the attachment area 71 of the mount 13. In addition, as shown in FIG. 2, the base attachment portion 15*a* has two through-holes 83 for the lead wires 27 and 29, and a screw-hole 85 for fixing the mount 13 into position. The two through-holes 83 are aligned with the two through-holes 75 of the mount 13 and the screw-hole 85 is aligned with the through-hole 77 of the mount 13.

As shown in FIG. 3, the module attachment portion 15*b* has a shape similar to an inversion of the shape of the base attachment portion 15*a*. The module attachment portion 15*b* has a modified circular truncated cone shape that lacks portions of the circular truncated cone shape that would protrude beyond the rectangular shape of the LED module 5 in plan view. As shown in FIG. 2, the fitting protrusion portion 87 is formed at a central position of an upper end surface of the module attachment portion 15*b*, and is for fitting to the fitting hole 35 that is formed in the mounting board 21 of the LED module 5.

(7) Circuit Unit

The circuit unit 17 receives power via the base 11, converts the power to LED applicable power, and supplies the converted power to the LED module 5 (the LEDs 3). As shown in FIG. 3, the circuit unit 17 is composed of the circuit substrate 91 and electrical components 93, 95, and 97 that are mounted on the circuit substrate 91.

In plan view, the circuit substrate 91 has a shape similar to a circular shape, and has the cutaway portion 91*a* and the cutaway portion 91*b* that correspond to protruding portions of the inner circumference of the large diameter portion 9*a* of the case 9 (specifically, an upper portion of the fitting portion 45*a*). Thus, the circuit substrate 91 is restricted from rotating inside the case 9. Two cutaway portions 91*d* are formed on a circumferential rim of the circuit substrate 91, opposite each other across the center of the circuit substrate 91. The two cutaway portions 91*d* are for the lead wires 27 and 29, which connect the circuit unit 17 and the LED module 5. When the LED lamp 1 is in an assembled state, the two cutaway portions 91*d* are positioned, in plan view, along the imaginary straight line D and an imaginary straight line E, which are shown in FIG. 7B.

The electrical components of the circuit unit 17 include a rectification circuit that rectifies commercial power (AC) received via the base 11, a smoothing circuit that smoothes rectified DC power, a step-down circuit that steps-down a smoothed voltage to a predetermined voltage, etc.

Here, the rectifying circuit includes a diode bridge 93, the smoothing circuit includes a capacitor 95, and the step-down circuit includes a transistor 97, a capacitor 99, a switching element, etc.

Note that, of the electrical components, the diode bridge 93, for example, is attached to a main surface of the circuit substrate 91 on side that is closer to the globe 7 than an opposite side of the circuit substrate 91 that is closer to the base 11. Also, the circuit substrate 91 is between the support unit 45 and the insulation member 19, inside the case 9 in such a way that there is a slight possibility of the circuit substrate 91 moving up and down.

(8) Insulation Member

As shown in FIG. 3, FIG. 6A, FIG. 6B, FIG. 7A, FIG. 7B, and FIG. 8, the insulation member 19 has a bottomed cylindrical shape, is formed from a resin material, and is inserted into and fixed to the inside of the cylinder portion 13*a* of the mount 13. The insulation member 19 has a bottomed cylinder portion 19*a* and a flange portion 19*b*. The bottomed cylinder portion 19*a* has a cylindrical portion that is a circumferential wall of the insulation member 19 and an end wall at one end of the cylindrical portion. The flange portion 19*b* projects outward in a radial direction from the other end of the cylindrical portion of the bottomed cylinder portion 19*a*. As shown in the lower portion of FIG. 7B, a plurality of protrusion portions 101 (here, four protrusion portions 101) are formed at regular intervals in a circumferential direction on an outer circumferential surface of the bottomed cylinder portion 19*a*. The protrusion portions 101 are for fixing the insulation member 19 to the mount 13.

A pair of a protrusion 103*a* and a protrusion 103*b* are formed on the flange portion 19*b*, protruding upward into an area between pieces of the flange portion 13*c* that are adjacent in the circumferential direction of the cylinder portion 13*a* (an area 13*d* where the flange portion 13*c* is not present). Four pairs of the protrusion 103*a* and the protrusion 103*b* are formed. Each pair corresponds to one of the four areas where the flange portion 13*c* of the mount 13 is not present. Thus, the pairs of the protrusion 103*a* and the protrusion 103*b* are usable as a guide for aligning the insulation member 19 and the mount 13 when attaching the insulation member 19 to the mount 13, and restrict rotation of the insulation member 19 relative to the mount 13 when the insulation member 19 is attached to the mount 13.

As shown in FIG. 3, FIG. 6A, and FIG. 6B, a surface of the end wall of the bottomed cylinder portion 19*a* that faces the globe direction is flat. As shown in FIG. 8, a thick portion 104 protrudes in the base direction from a central area of a surface of the end wall of the bottomed cylinder portion 19*a* that faces the base direction. Two through-holes 105 are provided that penetrate the thick portion 104, for the lead wires 27 and 29 that connect the circuit unit 17 and the LED module 5. A through-hole 107 is provided that penetrates the thick portion 104, for the screw 121 that is for fixing the extension member 15 into position.

As shown in the bottom portion of FIG. 7B, the through-hole 107 is positioned along a central axis of the insulation member 19 (in plan view, at the center of the end wall), and the two through-holes 105 are positioned on the imaginary straight line E that passes across the through-hole 107. In plan view, the imaginary straight line E is coincident with the imaginary straight line D. Note that the through-holes 105 are wider than the through-holes 75 of the mount 13, in order that the lead wires 27 and 29 pass through the two through-holes 105 easily.

As shown in FIG. 8, in a substantially central area of the thick portion 104, a concave portion 104*a* is formed for fitting a head portion 121*a* of the screw 121 that connects the mount 13, the insulation member 19, and the extension member 15.

Convex protrusion portions 19*c* protrude downward from a lower surface of the flange portion 19*b*, and are formed in two locations opposing each other. The convex protrusion portion 19*c* is for restricting upward movement of the circuit substrate 91 of the circuit unit 17. Note that the convex protrusion portion 19*c* and the circuit substrate 91 of the circuit unit 17 are in contact, and therefore a gap exists between the circuit substrate 91 and the insulation member 19 corresponding to a protrusion amount of the convex protrusion portion 19*c*. The lead wires 27 and 29 pass through the gap, and therefore disconnection of the lead wires 27 and 29 is prevented.

3. Assembly

The following is an explanation of assembly of the LED lamp 1, and particularly of how the parts join together. Note that in the following, only the joining of representative parts is explained, and the explanation may not coincide with the actual order of assembly of the LED lamp 1.

(1) Module and Extension Member

Joining of the LED module 5 and the extension member 15 is performed by (i) fitting the fitting hole 35 that is formed in the mounting board 21 of the LED module 5 to the fitting protrusion portion 87 that is formed at the upper end surface of the module attachment portion 15*b* of the extension member 15, (ii) inserting the lead wire 27 through one of the through-holes 31 and inserting the lead wire 29 through the other one of the through-holes 31, and (iii) fixing the upper ends of the lead wires 27 and 29 to the mounting board 21 by the soldering 33.

Here, since the fitting hole 35 and the fitting protrusion portion 87 each have a polygonal shape in plan view, rotation of the LED module 5 relative to the extension member 15 is restricted. Also, the center of the mounting board 21 is fixed in position by the fitting protrusion portion 87, and both end portions of the mounting board 21 in a longitudinal direction of the mounting board 21 are fixed in position by the lead wires 27 and 29. Thus, the LED module 5 is supported by the extension member 15, etc., in a stable state.

Note that, for increasing the coherence (contact) or reducing imperfections in the contact area between the mounting board 21 and the module attachment portion 15*b*, the mounting board 21 and the module attachment portion 15*b* may be, for example, fixed by an adhesive having a high thermal conductivity. Note that by increasing coherence between the mounting board 21 and the module attachment portion 15*b*, the amount of heat conducted from the LED module 5 to the extension member 15 is increased.

(2) Insulation Member and Mount

The insulation member 19 is attached to the mount 13 by inserting the bottomed cylinder portion 19*a* inside the cylinder portion 13*a* of the mount 13. The protrusion portions 101, which come in contact with an inner surface of the cylinder portion 13*a*, are formed on an outer circumferential surface of the bottomed cylinder portion 19*a* of the insulation member 19. Thus, the insulation member 19 is press-fitted to the mount 13.

Since the mount 13 is formed from metal material and the insulation member 19 is formed from resin material, it suffices to adjust the protrusion amount of the protrusion portions 101 to ensure that the protrusion portions 101 contact with the mount 13.

In other words, if the protrusion amount of the protrusion portion 101 is slightly larger than the gap between the inner circumferential surface of the cylinder portion 13*a* of the mount 13 and the outer circumferential surface of the bottomed cylinder portion 19*a* of the insulation member 19, compression of the protrusion portion 101 due to press-fitting reduces incidences of separation of the insulation member 19 from the mount 13.

On the other hand, if the protrusion amount of the protrusion portion 101 is considerably larger than the gap between the inner circumferential surface of the cylinder portion 13*a* of the mount 13 and the outer circumferential surface of the bottomed cylinder portion 19*a* of the insulation member 19, depression (deformation) of the cylindrical portion (circumferential wall) of the bottomed cylinder portion 19*a* in the vicinity of the protrusion portions 101 due to press-fitting reduces incidences of separation of the insulation member 19 from the mount 13.

As such, it suffices that the variation in the protrusion amount of the protrusion portions 101 is adjusted such that contact with the mount 13 is ensured at the lower limit of the protrusion amount of the protrusion portions 101. Thus, the protrusion portions 101, the insulation member 19, and the mount 13 do not require high manufacturing precision, and the insulation member 19 can easily be attached to the mount 13. In addition, easy separation of the insulation member 19 from the mount 13 is prevented.

Note that the mount 13 having the insulation member 19 attached thereto is called a base assembly.

(3) Extension Member and Base Assembly

The extension member 15 and the base assembly are joined (connected) by the screw 121

First, the fitting groove 81 on a lower surface of the base attachment portion 15*a* of the extension member 15 and the fitting protrusion portion 73 are fitted together to form a fitted state. In the fitted state, the through-hole 77 of the mount 13 and the screw-hole 85 of the extension member 15 are aligned, and the screw 121 is screwed into the screw-hole 85 of the extension member 15 from the insulation member 19 side of the base assembly via the through-hole 107 and the through-hole 77. In this way, assembly of the extension member 15 and the base assembly is completed.

Note that, in plan view, the fitting groove 81 of the extension member 15 and the fitting protrusion portion 73 of the mount 13 have a shape that is not a circular shape, centered on the axis of the screw 121. Here, the fitting groove 81 and the fitting protrusion portion 73 have matching elliptical shapes that are elongated in a direction parallel to a line through the axis of the screw 121. Thus, even when the screw 121 is screwed into the screw-hole 85 of the extension member 15, rotation of the extension member 15 relative to the base assembly is prevented.

Note that here, the screw 121 is made of metal. In order to ensure insulation between the screw 121 and the circuit substrate 91, after the screw 121 is screwed in and fixed inside the concave portion 104*a* of the thick portion 104 of the insulation member 19, the inside of concave portion 104*a* is filled up with a silicon resin 123, covering the screw 121 (refer to FIG. 2). The silicon resin 123 is insulative. Note that the silicon resin 123 also has a function of preventing loosening of the screw 121 and preventing separation of the screw 121 from the screwed-in position.

(4) Case and Circuit Unit

The circumferential rim of the circuit substrate 91 of the circuit unit 17 does not have a perfectly circular shape, and the circuit substrate 91 has the cutaway portions 91*a*, 91*b*, and 91*c*. The cutaway portions 91*a*, 91*b*, and 91*c* correspond to the upper portions of the three fitting portions 45*a* in the inner circumferential surface of the case 9. The cutaway portions 91*a*, 91*b* and 91*c* are each aligned to the corresponding one of the three fitting portions 45*a* and the circuit substrate 91 is inserted into the case 9 such that the capacitor 99 faces in the base direction.

Figure 9A:
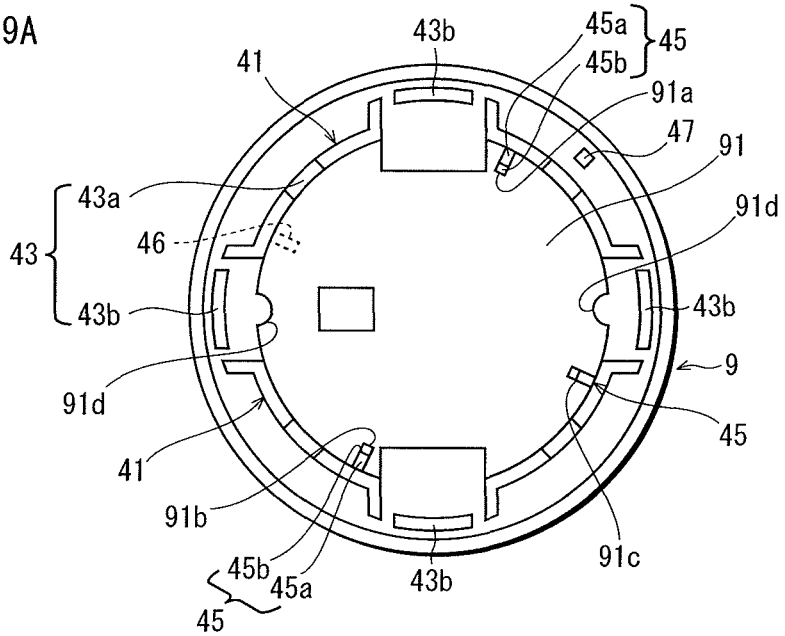
FIGS. 9A and 9B illustrate a state in which a circuit substrate is attached to the case, FIG. 9A being a plan view and FIG. 9B being a cross-sectional view.
Figure 9B:
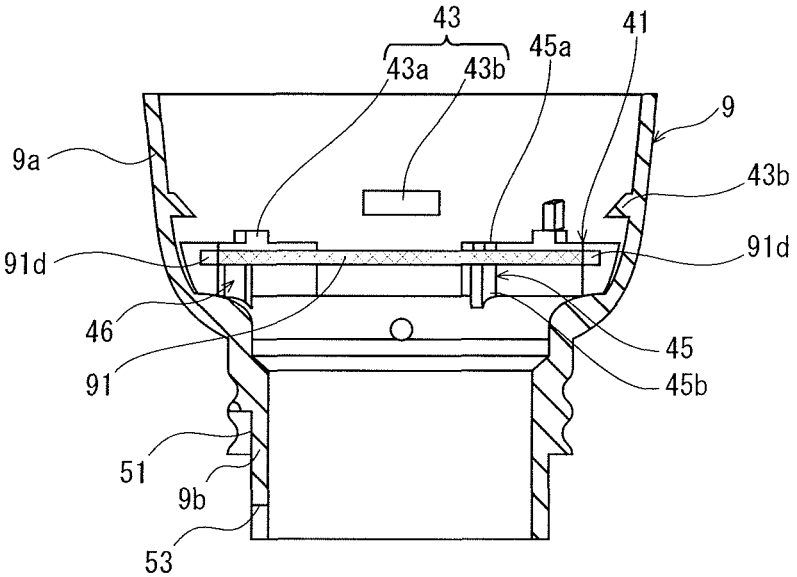

FIGS. 9A and 9B illustrate a state in which the circuit substrate 91 is inserted into the case 9. FIG. 9A is a plan view and FIG. 9B is a cross-sectional view.

In plan view, the fitting portion 45*a* protrudes toward the center of the case 9. Thus, as shown in FIG. 9A, when the three fitting portions 45*a* are fitted to the cutaway portions 91*a*, 91*b*, and 91*c*, respectively, the circuit substrate 91 does not rotate relative to the case 9.

As shown in FIG. 9A, the circumferential rim of the circuit substrate 91 that is not cutaway portions, etc. is in contact with or near to the arc portion 41*a* of the reinforcement unit 41. Thus, the circuit unit 17 does not move in a direction orthogonal to the central axis of the case 9.

Also, a portion of the support unit 45 relatively close to the center of the case 9 is stepped down in the base direction. As shown in FIG. 9B, the support portion 45*b*, which is stepped down, and the support unit 46 support a rear surface of the circuit substrate 91 (the rear surface facing the base direction).

Note that, as shown in FIG. 9A, a gap exists between the cutaway portions 91*d* of the circuit substrate 91 and the locking portions 43*b* of the case 9. The lead wire 27 passes through one of the gaps and the lead wire 29 passes through the other one of the gaps.

(5) Case and Base Assembly

Figure 10A:
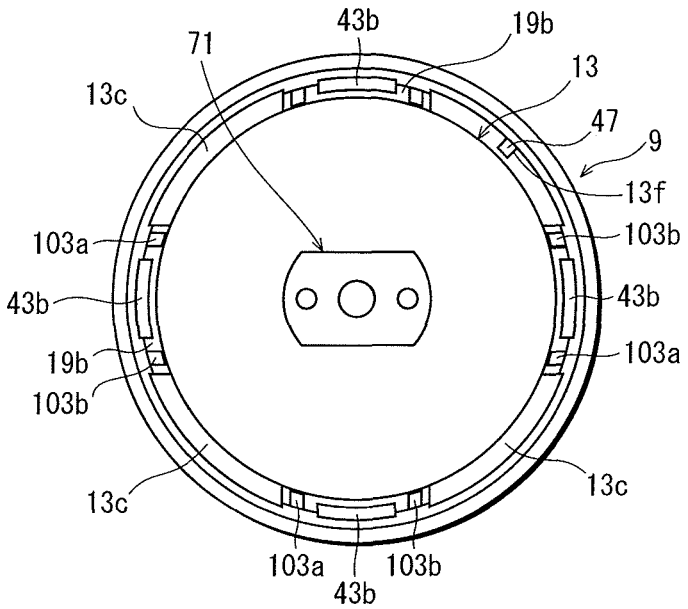
FIGS. 10A and 10B are illustrations for explaining a state in which a base assembly is attached to the case, FIG. 10A being a plan view and FIG. 10B being a cross-sectional view.
Figure 10B:
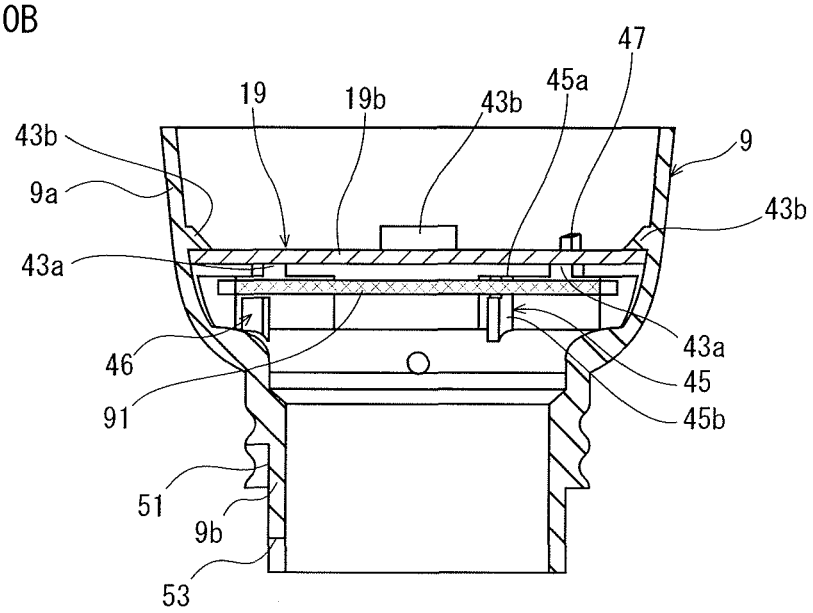

FIGS. 10A and 10B are illustrations for explaining a state in which the base assembly is attached to the case 9. FIG. 10A is a plan view and FIG. 10B is a cross-sectional view.

Note that in FIG. 10B, in order to show the joining of the flange portion 19*b* and the fixing unit 43 of the case 9, a cross-section of the flange portion 19*b* is shown as the cross-section of the insulation member 19.

First, the locking portions 43*b* of the fixing units 43 of the case 9 and one pair of the protrusions 103*a* and the protrusions 103*b* are aligned, and a lower surface of the flange portion 19*b* is placed on an upper surface of the locking portions 43*b* (a "placed state"). The aligning is performed such that the restriction groove 13*f* of the base assembly (the mount 13) and the rotation restriction unit 47 fit together. By performing the alignment, each of the locking portions 43*b* exists between a different one of the pairs of the protrusions 103*a* and the protrusions 103*b*.

Then, while in the placed state, the base assembly is pushed towards the small diameter in the base direction. As shown in FIG. 10B, as the locking portions 43*b* approach the small diameter portion 9*b*, the locking portions 43*b* protrude farther toward the center of the case 9, such that an upper surface of each of the locking portions 43*b* forms a slope. Therefore, by pushing the base assembly, the flange portion 19*b* of the base assembly passes by the locking portions 43*b*. Thus, as shown in FIG. 10B, a lower surface of the locking portions 43*b* comes in contact with an upper surface of the flange portion 19*b* of the insulation member 19, and movement of the base assembly in the globe direction is prevented.

On the other hand, as shown in FIG. 10B, after the base assembly passes by the locking portion 43*b*, a lower surface of the flange portion 19*b* of the insulation member 19 comes in contact with the support portions 43*a* of the case 9 to be supported from the base direction. Thus, the base assembly is attached to the case 9. Since each of the locking portions 43*b* is positioned between one of each of the pairs of the protrusions 103*a* and the protrusions 103*b*, rotation of the base assembly inside the case 9 is prevented.

Note that as shown in FIG. 10B, the circuit substrate 91 of the circuit unit 17 is positioned between the joining portion 45*a* of the case 9 and the insulation member 19 such that, although some up and down movement is possible, the circuit substrate 91 is contained inside the case 9.

4. Example of Implementation

The following is an explanation of an example of an implementation pertaining to the embodiment.

The LED lamp 1 is a replacement for a 20 W type incandescent light bulb, power input to the LED module 5 is 3.5 W, and when the power input is 3.5 W, a total luminous flux of the LED lamp 1 is 210 lm.

The LEDs 3 emit blue light. As the conversion material, fluorescent particles that convert blue light to yellow light are used. Thus, mixing of the blue light emitted by the LEDs 3 and yellow light from wavelength conversion by the fluorescent particles results in white light being emitted from the LED module 5 (the LED lamp 1).

In this example 24 LEDs 3 are disposed in two lines along a longitudinal direction of the mounting board 21, each line including 12 of the LEDs 3 disposed at regular intervals of 1.25 mm. The 12 LEDs 3 in each of the lines are electrically connected in series, and the two lines of the LEDs 3 are electrically connected in parallel.

The mounting board 21 has a shape of a rectangle having short sides (L1 in FIG. 4A) that are 6 mm long, and long sides (L2 in FIG. 4A) that are 25 mm long. The thickness of the mounting board 21 is 1 mm. Light-transmissive alumina is used as the material of the mounting board 21. Note that the volume of the mounting board is 150 $mm^3$.

The mount 13 has an outer diameter (the outer diameter of the cylinder portion 13*a*) of 30 mm and a height of 8 mm. The thickness of the cylinder portion 13*a* is 1.95 mm and the thickness of the cover portion 13*b* is 2.2 mm. Note that an amount of protrusion of the flange portion 13*c* from the outer circumference of the cylinder portion 13*a* is 1.65 mm and the height of the flange portion 13*c* is 2.0 mm.

The total length of the extension member 15 (the distance between an upper surface and a lower surface of the extension member 15, excluding the fitting protrusion portion 87 and the fitting groove 81) is 27 mm and the outer diameter of the connection portion 15*c* is 5 mm. The outer diameter of the lower end of the base attachment portion 15*a* is 10 mm. In plan view the module attachment portion 15*b* has a shape obtained by cutting away two portions from of a circle of diameter 8 mm. The two portions are defined by a pair of lines parallel to an imaginary line through the center of the circle and 3 mm distant from the imaginary line. The fitting protrusion portion 87 has a rectangular shape having a length (a measurement in the longitudinal direction of the LED module 5) of 1.9 mm and a width of 0.9 mm. Note that the protrusion amount of the fitting protrusion portion 87 from the module attachment portion 15*b* is 1 mm. Also note that the protrusion amount of the protrusion portion 101 of the insulation member 19 is 0.3 mm and a length of the protrusion portion 101 is 2 mm.

A contact area between the LED module 5 and the extension member 15 is 46.53 $mm^2$, and a contact area between the mount 13 and the extension member 15 (including the contact area between the fitting protrusion portion 73 and the fitting groove 81) is 81.43 $mm^2$.

5. Light Distribution Characteristics

In the LED lamp 1 pertaining to the embodiment, the LED module 5 is disposed at a position inside the globe 7 corresponding to the position (for example, in substantially the same position) of a light source of an incandescent light bulb (the filament). Thus, even if the LED lamp 1 is attached to a lighting apparatus that has a reflector for a conventional incandescent light bulb, the LED module 5 would be positioned at a focal point of the reflector. Therefore, light distribution characteristics similar to the light distribution characteristics of the conventional incandescent light bulb can be obtained.

Also, since the mounting board 21 in the LED module 5 is light-transmissive, light emitted backwards in the base direction from the LEDs 3 is transmitted through the mounting board 21 and emitted from the globe 7 to the outside of the LED lamp 1.

Further, since the extension member 15 that supports the LED module 5 has a long, thin, rod shape, obstruction of light emitted backward from the LEDs 3 is decreased.

6. Heat Dissipation Paths

The LED lamp 1 pertaining to the embodiment dissipates heat that is generated upon light emission by multiple paths. In the present embodiment, heat that is generated when emitting light includes heat generated by the LEDs 3 and heat generated by the circuit unit 17.

(1) Heat Generated by LEDs (a) The heat generated by the LEDs 3 is conducted through the mounting board 21 of the LED module 5, the extension member 15, and then the mount 13. Heat conducted to the mount 13 is conducted to the globe 7 and the case 9. A portion of the heat conducted to the globe 7 and the case 9 is dissipated by the effects of heat transfer, convection, and radiation. Also, a portion of the heat conducted to the case 9 is conducted from the base 11 to a socket on a lighting apparatus side.

(b) In the LED lamp 1, the globe 7 has a size and shape similar to a glass bulb of an incandescent light bulb. Therefore, the envelope volume of the globe 7 is large, and a large amount of heat is radiated from the globe 7. Thus, a large amount of heat generated by the LEDs 3 is, via the extension member 15 and the mount 13, dissipated from the globe 7.

(2) Heat Generated by Circuit Unit

Heat generated by the circuit unit 17 is conducted to the case 9 by heat transfer, convection, and radiation. A portion of heat conducted to the case 9 is dissipated from the case 9 by the effects of heat transfer, convection, and radiation, and the remaining heat is conducted to the socket on the lighting apparatus side.

(3) Thermal Load to Circuit Unit

In the LED lamp 1, the globe 7 has a size and shape similar to a glass bulb of an incandescent light bulb, and the LED module 5 is provided in a substantially central position inside the globe 7.

Thus, (a) the distance between the LED module 5 and the circuit unit 17 is increased, reducing the thermal load received by the circuit unit 17 from the LEDs 3, and (b) the distance between the LED module 5 and the case 9 is increased, reducing the amount of heat accumulated in the case 9 due to heat received from the LEDs 3. Thus, the size of the case 9 can be reduced. On the other hand, the globe 7 (the envelope volume of the globe 7) can be increased in size, increasing the amount of heat dissipated from the globe 7.

7. Protrusion Portion for Fixing Insulation Member (1) Number of Pieces

In the embodiment, the four protrusion portions 101 are formed at regular intervals in the circumferential direction of the bottomed cylinder portion 19*a*. However, it suffices that only one protrusion portion 101 be formed if attention is paid only to preventing the insulation member 19 falling apart from the mount 13. If only one protrusion portion 101 is formed, there is a possibility of axial misalignment between the insulation member 19 and the axis of the mount 13, but this can be adjusted for by forming larger through-holes for the lead wires 27 and 29, and the screw 121.

(2) Positions (2-1) Positions in Plan View

In the embodiment, the protrusion portions 101 are formed at 90 degree intervals in a circumferential direction of the bottomed cylinder portion 19*a*. However, for the same reason explained under the above heading "(1) Number of Pieces", the positions of the protrusion portions 101 in plan view is not specifically limited in this way. Nevertheless, in order to restrict axial misalignment between the insulation member 19 and the mount 13, positioning at least three protrusion portions 101 at regular intervals in plan view is desirable.

(2-2) Position in Side View

In the embodiment, the protrusion portions 101 are formed closer to an opening of the bottomed cylinder portion 19*a* than to the end wall thereof. This is because, when inserting the insulation member 19 into the mount 13, if the protrusion portions 101 were formed near the end wall, deformation by the protrusion portion 101 of the portion of the bottomed cylinder portion 19*a* near the end wall would be difficult, and therefore insertion of the insulation member 19 into the mount 13 would be difficult.

However, if the protrusion portions 101 are such that the protrusion amount of the protrusion portions 101 gradually increases with increasing distance from the end wall, the protrusion portion 101 may be positioned near the end wall, or may be elongated from the end wall to the opening of the bottomed cylinder portion 19*a*.

(3) Shape of Protrusion Portion (3-1) Overall Shape

In the embodiment, the protrusion portions 101 are formed having a ridge shape and are elongated parallel to the central axis of the bottomed cylinder portion 19*a* of the insulation member 19. However, the protrusion portions 101 may each have a bump shape (a dot shape). Also, each of the protrusion portions 101 in the embodiment has a ridge shape that has a constant protrusion amount and width. However, each of the protrusion portions 101 may have a ridge shape that has a variable protrusion amount and width. Specifically, each of the protrusion portions 101 may have a shape such that the protrusion amount and width of each of the protrusion portions 101 gradually increases with increasing distance from the end wall.

Also, each of the protrusion portions 101 may have an arc shape following the outer circumferential surface of the bottomed cylinder portion 19*a* in plan view. In such a case, each of the protrusion portions 101 may have an inclined surface, and increase in arc as the position of the arc shape approaches the opening of the bottomed cylinder portion 19*a*.

(3-2) Cross-Sectional Shape

In the embodiment, a cross-section of each of the protrusion portions 101 before attachment of the insulation member 19 to the mount 13 (the cross-section being taken along a plane orthogonal to the central axis of the insulation member 19, viewed in a direction of extension of the central axis of the insulation member 19) is a triangle shape that tapers off as each of the protrusion portions 101 approaches the mount 13 from the insulation member 19. However, the shape of each of the protrusion portions 101 in cross-section may be other shapes. Examples of shapes that taper off, other than triangle shapes, include semicircle shapes, semi-elliptical shapes, trapezoid shapes, and polygonal shapes. Examples of shapes that do not taper off include square shapes and rectangular shapes.

<Modifications>

An explanation is given above based on an embodiment of the present invention, but the present invention is not limited to the above embodiment. For example, the following modifications are possible.

1. Mount and Extension Member

In the above embodiment, the extension member and the mount are separate members and are joined by the screw, but, for example, the extension member and the mount may be integrated into a single body. Die casting or machining may be used to form the single body.

In the above embodiment, the extension member has a rod shape, but the extension member may have any shape or structure that positions the LEDs (the LED module) inside the globe.

For example, the extension member may have a cone shape or a polygonal pyramid shape, and further, may have a shape that becomes narrower through a series of steps as an upper part of the extension member is approached. Furthermore, the extension members may be provided in a plurality. For example, two rod-shaped extension members may be used to support both end portions of the mounting board of the LED module in the longitudinal direction of the mounting board (the end portions corresponding to the short sides of the mounting board), or four rod-shaped extension members may be used to support four corners of the rectangular mounting board.

In the above embodiment, a transverse cross-section of the cylinder portion of the mount has a circular shape, but as long as the extension member attaches to the cylinder portion and the cylinder portion closes one open end of the case, other shapes are possible. Examples of other shapes of the transverse cross-section include elliptical shapes or polygonal shapes.

2. Insulation Member

In the above embodiment, the insulation member has a bottomed cylindrical shape, but as long as the insulation member has a cylindrical portion that can be inserted into the inside of the cylinder portion of the mount, the insulation member may have other overall shapes. For example, the insulation member may have other overall shapes, such as a shape including a flat portion having a flat shape and a cylinder portion protruding from a central area of the flat shape.

Also, in the above embodiment, the insulation member has a bottomed cylindrical shape having the end wall as the bottom, but in a case where insulation is ensured between the cover portion of the mount and the circuit unit, the end wall is not required.

In the above embodiment, the insulation member has a bottomed cylindrical shape, and the end wall is in contact with the cover portion of the mount. Thus, accuracy when positioning the insulation member with respect to the mount is increased. On the other hand, to make conduction of heat from the mount to the insulation member more difficult, it suffices that faces of the end wall and the cover portion are not in surface contact with each other. Note that by providing an upper surface of the end wall with a bump portion contacting the cover portion of the mount, heat conduction to the insulation member from the mount is suppressed, while maintaining accuracy when positioning the insulation member with respect to the mount.

3. LED module (1) LED

In the above embodiment, LED elements are used as the light source of the lamp. However, for example, surface-mount type or shell-type LEDs may be used, such that each LED element is resin sealed and the LED module is composed of the mounting board and the LEDs.

In the above embodiment, an example is given in which the LEDs emit blue light and the fluorescent particles convert blue light to yellow light, but other combinations are possible. As one example of a different combination, the LEDs may emit ultra-violet light and three types of fluorescent particle may be used to enable the lamp to emit white light: a particle that converts ultra-violet light to red light, a particle that converts ultra-violet light to blue light, and a particle that converts ultra-violet light to green light.

Further, the lamp may be configured to emit white light by using three types of LED elements: a first type emitting red light, a second type emitting green light, and a third type emitting blue light, and by mixing the three colors emitted by the three types of LED elements. Note that the color of light emitted from the LED module is of course not limited to white, and according to the purpose of the lamp, a variety of LEDs (including LED elements and surface-mounted LEDs) and fluorescent particles may be used.

(2) Mounting Board

In the above embodiment, an explanation is given of an example in which the mounting board has a rectangular shape in plan view. However, the shape of the mounting board in plan view is not specifically limited in this way. For example, in plan view the mounting board may have a circular shape, an elliptical shape, a polygonal shape, etc.

Also, in the above embodiment, an explanation is given of an example mounting board which is a board having a small thickness (an area of a side surface is smaller than an area of an upper surface). However, for example, the mounting board may be a board having a large thickness or a block shape.

Note that regardless of the shape, thickness, and form of the mounting board, the mounting board in the present specification indicates a mount on which the LEDs (including LED elements and surface-mounted LEDs) are mounted, and that has a pattern that is electrically connected to the LEDs. Accordingly, the mounting board may have the block shape mentioned above, or may be the mounting board and the extension member pertaining to the embodiment configured as a single body.

In the above embodiment, the mounting board is formed from light-transmissive material, but in a case where emitting light backward, in the base direction, is not required the mounting board may be formed from material other than light-transmissive material.

(3) Attachment position

The LED module in the above embodiment has a mounting board formed from a light-transmissive material in order to irradiate light backward, in the base direction, but light may be irradiated backward, in the base direction, by other methods.

As another method, the mounting board may be formed from material that is not light-transmissive material, and the LEDs may be mounted on both main surfaces of the mounting board. As yet another method, the mounting board may be formed from material that is not light-transmissive material, the mounting board may have a spherical shape, a cube shape, etc. (for example, the mounting board may include six insulated boards joined in three-dimensions to form a cube shape), and the LEDs (including shell-type LEDs and surface-mounted LEDs) may be mounted on a surface of the mounting board.

(4) Light-Emitting Elements

In the above embodiment and modifications, LEDs are used as the light-emitting elements, but light-emitting elements other than LEDs may be used. As other light-emitting elements, for example, EL light-emitting elements (including organic and inorganic) or LD, etc., may be used, or a combination of such light-emitting elements, including LEDs, may be used.

4. Globe (1) Form

In the above embodiment, an A-type globe or R-type globe is used, but other types, such as B-type globes or G-type globes may be used, or globe shapes completely different from the bulb shapes of incandescent light bulbs and light-bulb shaped fluorescent lamps may be used.

Also, in the above embodiment, the globe is formed as a single body, but, for example, the globe may be a plurality of pieces that are produced separately and assembled as one globe. In such a case, every piece does not have to be made from the same material, and, for example, the globe may be a combination of pieces composed of resin and pieces composed of glass. Note that the use of a globe assembled from a plurality of pieces allows the use of an LED module that is larger than the opening at the lower end of the globe.

The globe may be light-transmissive such that the interior of the globe is visible, or may be semitransparent such that the interior of the globe is not visible. A semitransparent globe, for example, may be implemented by applying a diffusion layer having a primary component such as calcium carbonate, silica, white pigment, etc., to an inner surface of the globe, and applying a treatment for roughening an inner surface of the globe (for example, a blast treatment).

(2) Size

In the above embodiment, an explanation is not specifically given of a ratio of a length of the globe to a total length of the lamp. Here, a globe ratio means a total length of the globe relative to the total length of the lamp. The total length of the globe is a length of the central axis of a portion of the globe that is exposed to outside air.

The globe ratio is preferably equal to or greater than 0.54. If the globe ratio is less than 0.54, a surface area of the portion of the globe that is exposed to outside air is small, and a sufficient heat dissipation characteristic of the globe cannot be obtained. Also, if the globe size is decreased, the distance between the LED module and the circuit unit is decreased, and when the lamp is lit, heat received by the circuit unit from the LED module is increased, affecting the circuit unit.

(3) Material

In the above embodiment, a glass material is used as the material of the globe, but other light-transmissive materials, for example a resin material, may be used.

5. Case

In the above embodiment, the envelope that includes the globe and the case has a shape similar to an incandescent light bulb, but the envelope may have other shapes. Also, in the above embodiment explanation was not specifically given regarding an outer surface of the case, but, for example, in order to increase an envelope volume of the case, heat dissipation grooves and heat dissipation fins may be provided on the outer surface of the case.

6. Envelope

In the above embodiment, a particular treatment is not applied to the outer circumferential surface of the envelope that includes the globe and the case. However, coating material having a desired function may be applied to all or part of the outer circumferential surface of the envelope. Examples of such functions include a shatter prevention function, an ultraviolet light shielding function, an anti-fogging function, etc.

A shatter prevention function prevents scattering of fragments of the envelope if the envelope is damaged for any reason. As the coating material, for example, urethane resin and silicone resin, etc., may be used. Note that the coating material having a shatter prevention function may be applied to the globe only (a part of the envelope).

An ultraviolet light shielding function prevents exposure of the envelope to ultraviolet light, and thus prevents changes in color and reduction in strength of the envelope. As the coating material having the ultraviolet light shielding function, for example, polyolefin-type resin, etc., may be used.

An anti-fogging function prevents fogging of primarily the globe (a part of the envelope) when the lamp is used in a high humidity ambient atmosphere. As the coating material having the anti-fogging function, for example, acrylic resin, etc., may be used.

7. Base

In the above embodiment, an Edison-type base is used, but other types of bases, for example pin-type bases (specifically, G-type bases such as GY and GX) may be used.

Also, in the above embodiment, the base is attached to the case by a female thread of the shell portion of the base being screwed into the male thread of the case, but the base may be attached to the case by another method. As another method, attaching by adhesive, attaching by caulking, attaching by pressure, etc., or attaching by a combination of two or more of the above methods is possible.

8. LED position

In the present embodiment, the position of the LEDs inside the globe corresponds to the position of a filament of an incandescent light bulb. Specifically, the globe has a shape similar to an incandescent light bulb (A-type), and has a spherical portion and a cylindrical portion. Further, the LEDs (the LED module) are, if the globe shape corresponds to an A-type incandescent light bulb, arranged in a central position of the spherical portion.

The position described above is a position relative to the globe and is the central position of the spherical portion. However, from the base, the distance from an end tip of the base (an end tip of the eyelet portion) to the position of the LEDs is substantially the same as the distance from an end tip of a base of an incandescent light bulb to a filament of the incandescent light bulb.

However, the structure of the present invention is not limited to a globe that has an A-type shape as described above. For example, the globe may have a cylindrical shape that is closed at an end portion opposite the base. In such a case, the LEDs may be positioned at a focal point of a reflector of a lighting apparatus to which the lamp is attached, or a light-emission center of a lamp that the lamp is replacing (for example, a krypton bulb, a fluorescent bulb-type lamp, etc.).

9. Lighting Device

In the above embodiment and elsewhere, explanation is primarily given of the LED lamp, but the following is an explanation of a lighting device that uses the LED lamp. In other words, the present lighting device includes at least one of the varieties of the lamp described above and a lighting apparatus that attaches and lights up the lamp.

In the LED lamp explained under the heading Background Art (hereafter, "conventional LED lamp"), the case is used as a heat dissipation part, and therefore the case is large. In such a case, the LEDs are farther from the base than a filament is from a base in an incandescent light bulb. In other words, the position of the LEDs in the conventional LED lamp seen as a whole (distance from the base) is different from the position of the filament in an incandescent lamp seen as a whole (distance from the base).

When the conventional LED lamp is used with a reflector that is included in a lighting apparatus that an incandescent light bulb was attached to, for example when using the conventional LED lamp as a downlight, problems occur such as an annular shadow on a surface irradiated by the conventional LED lamp. In other words, due to differences in light source position between the conventional LED lamp and a conventional incandescent light bulb, problems occur with light distribution characteristics, etc.

Figure 11:
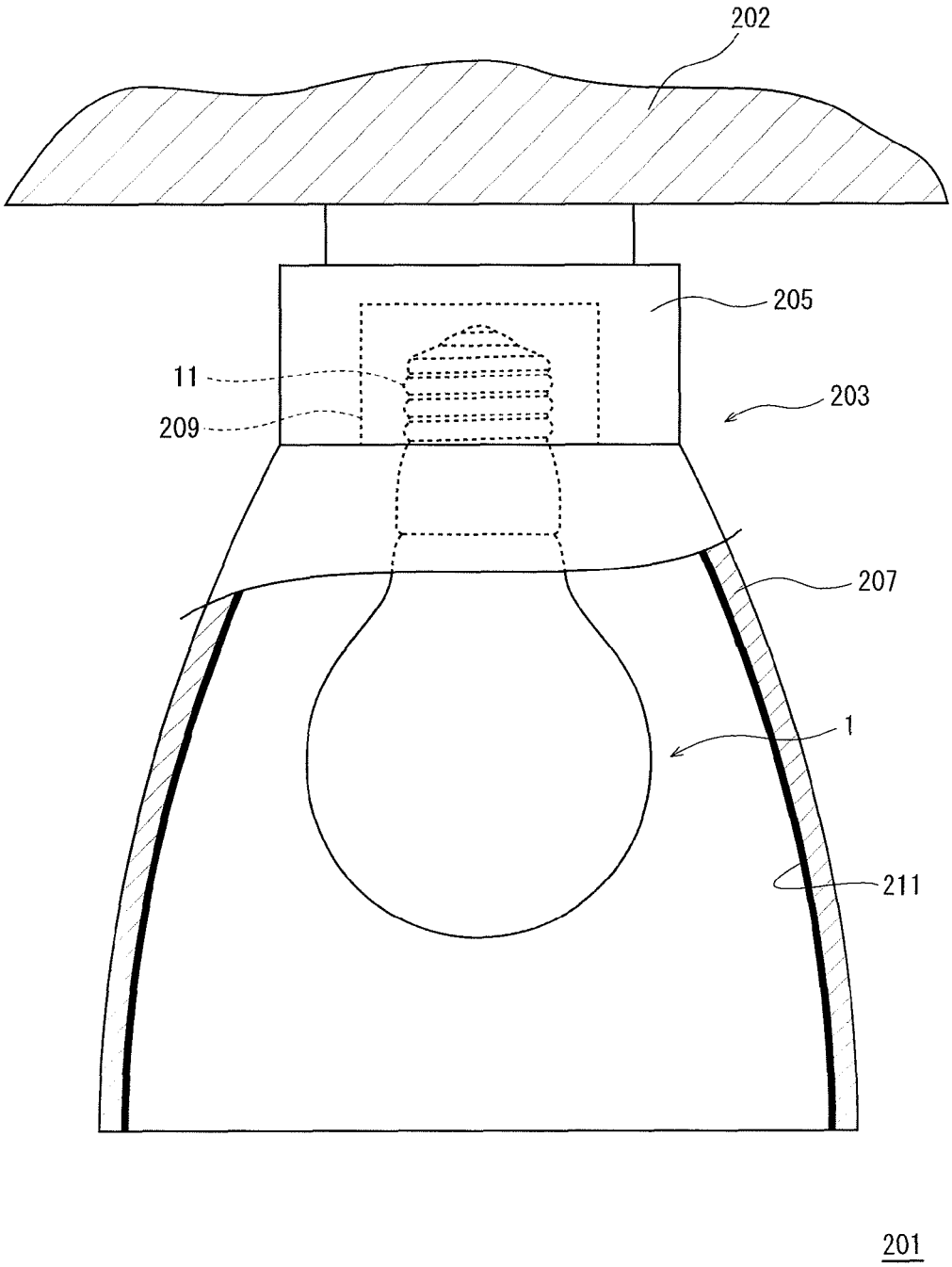
FIG. 11 is a schematic view of a lighting device pertaining to another embodiment.

FIG. 11 is a schematic view of a lighting device 201 pertaining to another embodiment.

The lighting device 201 is used, for example, while attached to a ceiling 202.

As shown in FIG. 11, the lighting device 201 includes the LED lamp 1 and a lighting apparatus 203 to which the LED lamp 1 is attached. The lighting apparatus 203 lights up and turns off the LED lamp 1.

The lighting apparatus 203 includes, for example, an equipment main body 205 that is attached to the ceiling 202 and a cover 207 that is attached to the equipment main body 205 and covers the LED lamp 1. The cover 207 in the present example is an open-type cover that has a reflection film 211 on an inner surface thereof. The reflection film 211 reflects light emitted from the LED lamp 1 in a predetermined direction (downward, in the present example).

The equipment main body 205 includes a socket 209 to which the base 11 of the LED lamp 1 is attached (screwed into). Electricity is supplied to the LED lamp 1 via the socket 209.

In the present example, since the position of the LEDs 3 (the LED module 5) of the LED lamp 1, which is attached to the lighting apparatus 203, is similar to the position of a filament of an incandescent light bulb, a light-emission center of the LED lamp 1 is positioned similarly to a light-emission center of the incandescent light bulb.

Thus, even when the LED lamp 1 is attached to the lighting apparatus 203, to which the incandescent light bulb was attached, since the position of the light-emission center of the LED lamp 1 and the incandescent light bulb is similar, problems such as an annular shadow on a surface irradiated by the LED lamp 1 are less likely to occur.

Note that the above-described lighting apparatus is one example, and the lighting apparatus 203 may, for instance, not have the cover 207, which is an open type, and instead have a closed type cover. The lighting apparatus 203 may also orientate the LED lamp 1 sideways (an orientation where the central axis of the lamp is horizontal), or obliquely (an orientation where the central axis of the lamp is oblique, relative to the central axis of the lighting apparatus), and light up the LED lamp 1.

Also, the lighting device in the present example includes the lighting apparatus 203 that is a direct attachment type that, in a state of contact with a ceiling or wall, is attached to the ceiling or the wall. However, the lighting apparatus 203 may be an embedded type that, in a state of being embedded in a ceiling or wall, is attached to the ceiling or the wall, or the lighting apparatus 203 may be a suspended type that is suspended from a ceiling by an electric cable of the lighting apparatus 203.

Furthermore, in the present example, the lighting apparatus lights up one LED lamp (the LED lamp 1) that is attached thereto, but the lighting apparatus may light up a plurality, for example three, LED lamps attached thereto.

INDUSTRIAL APPLICABILITY

The present invention provides an LED lamp that has a simple structure and that is easy to assemble.

REFERENCE SIGNS LIST

1 LED lamp
3 LEDs
5 LED module
7 globe
9 case
11 base
13 mount
13*a* cylinder portion
13*b* cover portion
15 extension member
17 circuit unit
19 insulation member
19*a* bottomed cylinder portion
19*b* flange portion
101 protrusion portion

The invention claimed is:

1. A lamp comprising:
an envelope that includes a globe and a case;
a mount made of an electrically conductive material and having a cylinder portion and a cover portion that closes one end of the cylinder portion, the mount closing an opening at one end of the case;
an extension member mounted on the cover portion of the mount and extending into the globe;
a light-emitting element attached to the extension member and disposed inside the globe;
a circuit unit disposed inside the case and configured to light the light-emitting element; and
an insulation member disposed inside the case and insulating the circuit unit from the mount, wherein
the insulation member has a cylindrical portion that is inserted into the cylinder portion of the mount and has a protrusion portion that is formed on an outer circumference of the cylindrical portion and that protrudes toward the mount, the insulation member being attached to the mount by the protrusion portion pressing on an inner surface of the cylinder portion of the mount.

2. The lamp of claim 1, wherein
the protrusion portion is a plurality of protrusion portions disposed in a circumferential direction of the cylindrical portion, each protrusion portion being elongated in a direction parallel to the central axis of the cylindrical portion.

3. The lamp of claim 1, wherein
the protrusion portion is a plurality of protrusion portions disposed in a circumferential direction of the cylindrical portion, each protrusion portion having a bump shape.

4. The lamp of claim 1, wherein
the insulation member has an end wall disposed at one of two ends of the cylindrical portion, and
the protrusion portion is disposed closer to the other one of the two ends of the cylindrical portion than the one end at which the end wall is disposed.

5. The lamp of claim 2, wherein
the insulation member has an end wall disposed at one of two ends of the cylindrical portion, and
the protrusion portion is disposed closer to the other one of the two ends of the cylindrical portion than the one end at which the end wall is disposed.

6. The lamp of claim 3, wherein
the insulation member has an end wall disposed at one of two ends of the cylindrical portion, and
the protrusion portion is disposed closer to the other one of the two ends of the cylindrical portion than the one end at which the end wall is disposed.

7. The lamp of claim 4, wherein
the cover portion of the mount and the end wall of the insulation member are in contact with each other,
a through hole passes through the cover portion of the mount and the end wall of the insulation member, and
the extension member is fixed by a screw member, which has a head portion disposed inside the cylindrical portion of the insulation member and a screw portion that passes through the through hole.

8. The lamp of claim 5, wherein
the cover portion of the mount and the end wall of the insulation member are in contact with each other,
a through hole passes through the cover portion of the mount and the end wall of the insulation member, and
the extension member is fixed by a screw member, which has a head portion disposed inside the cylindrical portion of the insulation member and a screw portion that passes through the through hole.

9. The lamp of claim 6, wherein
the cover portion of the mount and the end wall of the insulation member are in contact with each other,
a through hole passes through the cover portion of the mount and the end wall of the insulation member, and
the extension member is fixed by a screw member, which has a head portion disposed inside the cylindrical portion of the insulation member and a screw portion that passes through the through hole.

* * * * *